US008733247B2

(12) United States Patent
Schmidt

(10) Patent No.: US 8,733,247 B2
(45) Date of Patent: May 27, 2014

(54) SHEET-FED OFFSET PRINTING PRESS FOR PRINTING ON BOTH SIDES OF SHEETS

(75) Inventor: Thomas Schmidt, Eppelheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 725 days.

(21) Appl. No.: 12/569,076

(22) Filed: Sep. 29, 2009

(65) Prior Publication Data

US 2010/0077933 A1 Apr. 1, 2010

(30) Foreign Application Priority Data

Sep. 29, 2008 (DE) ..... 10 2008 049 473

(51) Int. Cl.
*B41F 7/02* (2006.01)
*B41F 13/54* (2006.01)

(52) U.S. Cl.
USPC ..... 101/217; 101/229; 101/231

(58) Field of Classification Search
USPC ..... 101/204, 202, 352.01, 132.5, 350.1, 101/217, 87, 191, 184, 185, 192, 218, 247, 101/283, 229, 230, 220
See application file for complete search history.

(56) References Cited

U.S. PATENT DOCUMENTS

| | | | | |
|---|---|---|---|---|
| 4,409,894 | A | 10/1983 | Fischer | |
| 4,934,265 | A | 6/1990 | Knauer | |
| 5,931,091 | A * | 8/1999 | Kobayashi | 101/177 |
| 6,293,193 | B1 | 9/2001 | Bolza-Schünemann | |
| 7,131,376 | B2 * | 11/2006 | Yamamoto et al. | 101/350.1 |
| 7,284,482 | B2 | 10/2007 | Inoue et al. | |
| 7,404,357 | B2 * | 7/2008 | Knabe | 101/415.1 |

FOREIGN PATENT DOCUMENTS

| | | | |
|---|---|---|---|
| CN | 1781705 | A | 6/2006 |
| DE | 437 203 | | 11/1926 |
| DE | 31 08 806 | A1 | 11/1982 |
| DE | 33 27 791 | C1 | 3/1985 |
| DE | 197 56 796 | A1 | 7/1999 |
| DE | 197 56 990 | A1 | 7/1999 |
| EP | 1669197 | A2 | 6/2006 |

* cited by examiner

*Primary Examiner* — Matthew G Marini
(74) *Attorney, Agent, or Firm* — Laurence A. Greenberg; Werner H. Stemer; Ralph E. Locher

(57) ABSTRACT

A sheet-fed offset printing press for printing on both sides of sheets has a compact construction and permits a number of color separations to be printed over one another in recto printing or recto and verso printing in a flexible manner and with high print quality. A plurality of printing units, which are disposed behind one another, each include at least one form cylinder, a transfer cylinder, a first impression cylinder and an inking unit having at least one ink applicator roll associated with the form cylinder. A second impression cylinder, which interacts with the transfer cylinder and the first impression cylinder, is provided in at least one printing unit.

15 Claims, 6 Drawing Sheets

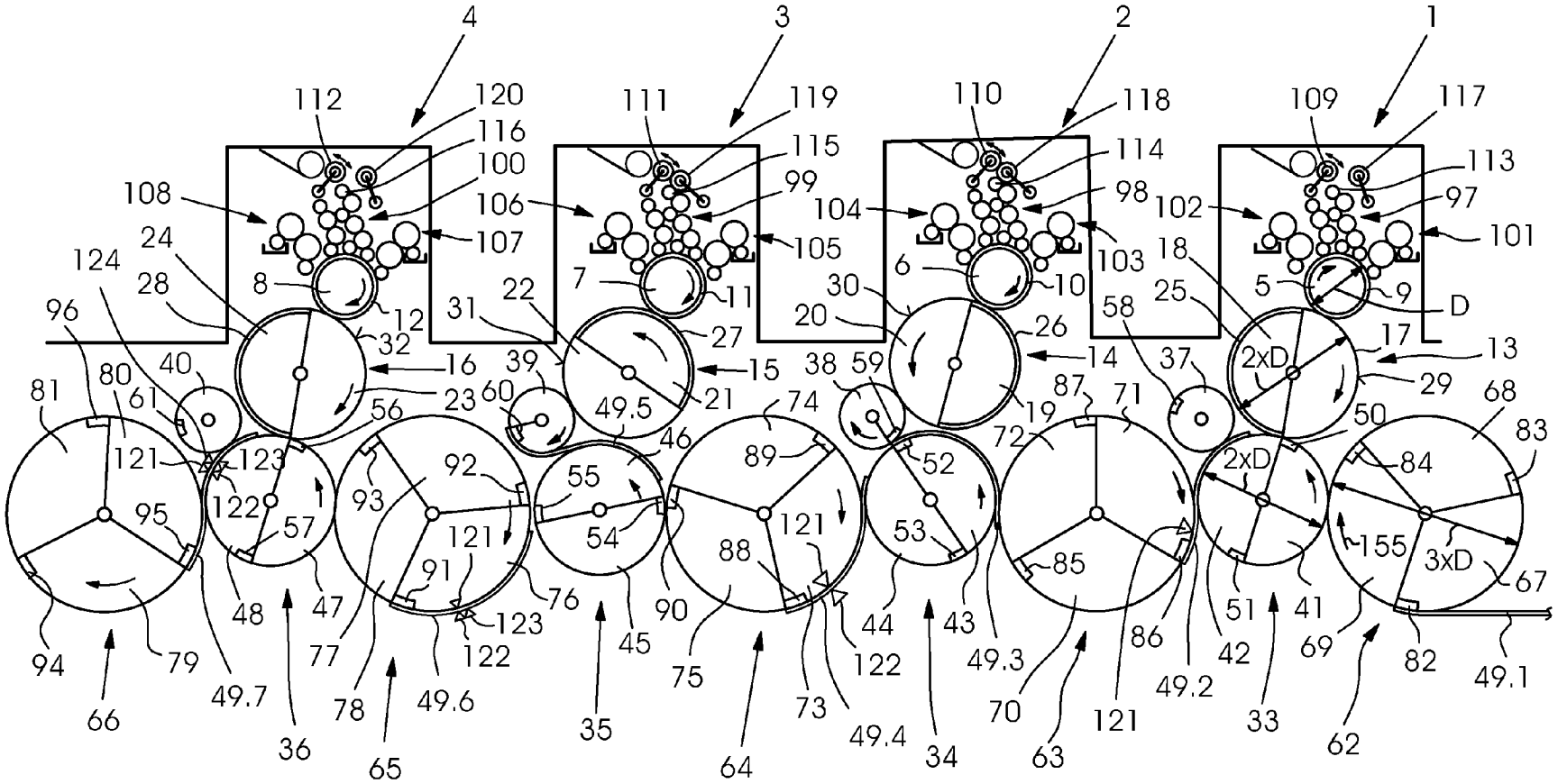
FIG. 1.1

FIG. 1.2
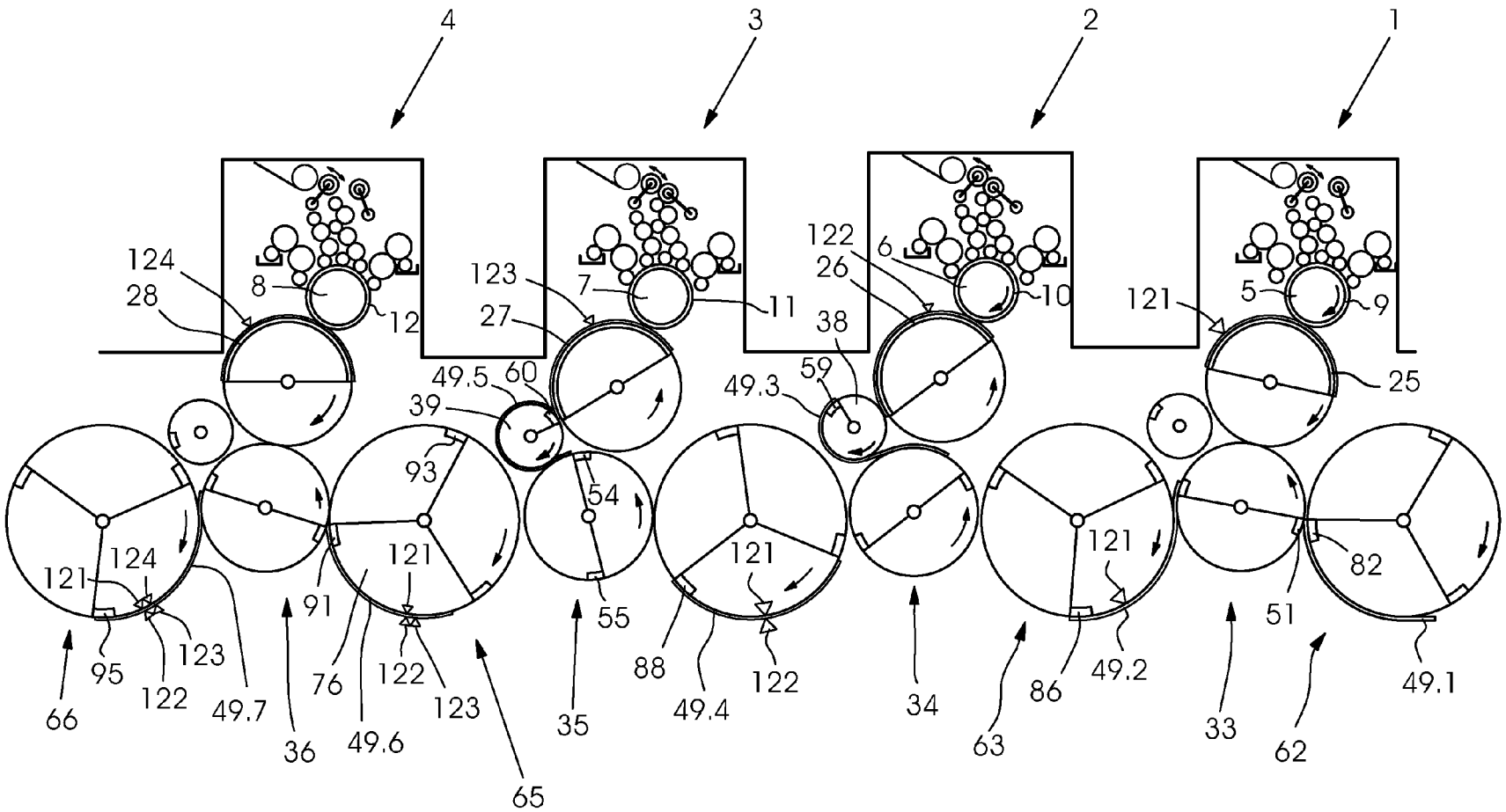

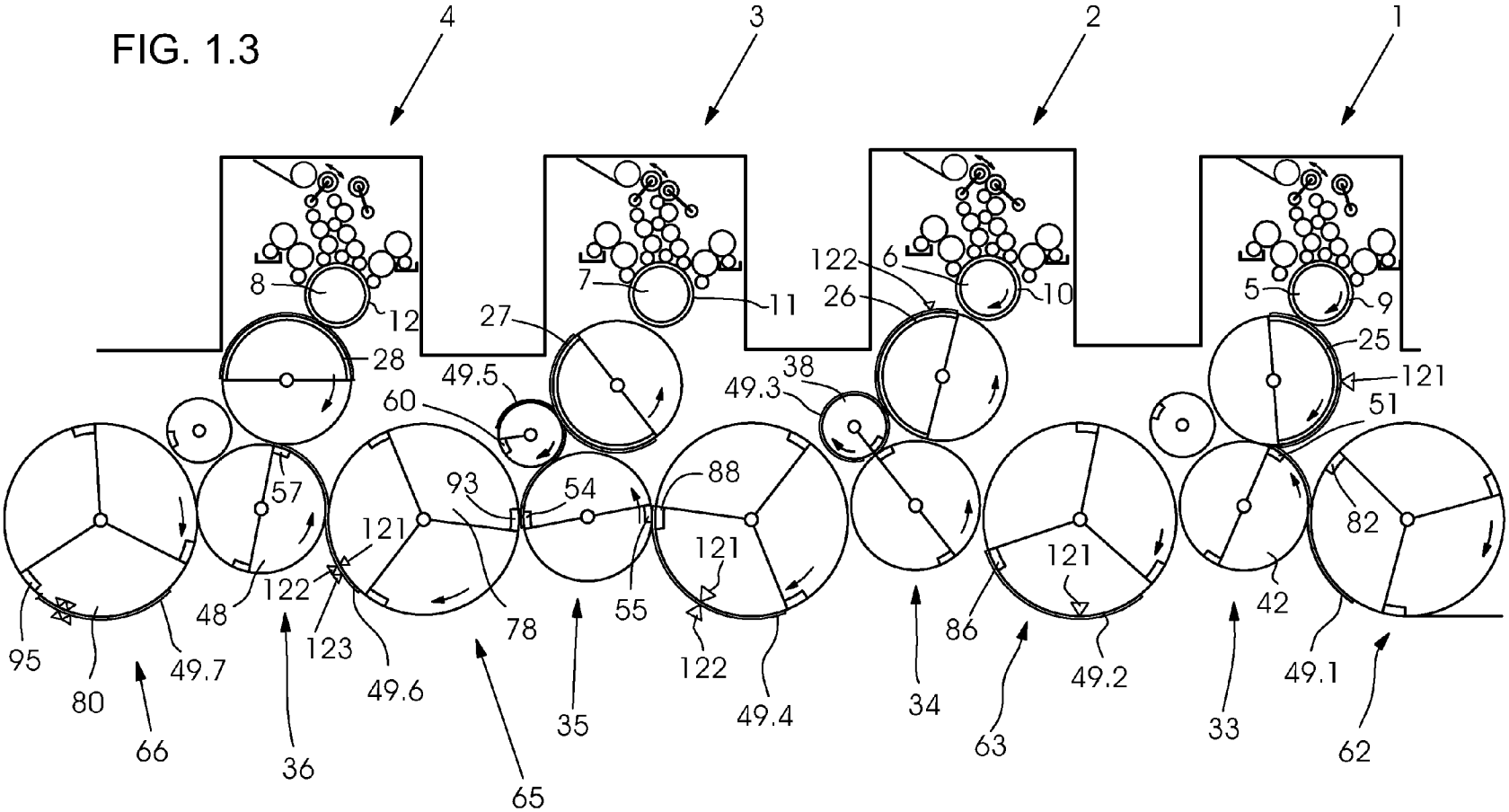
FIG. 1.3

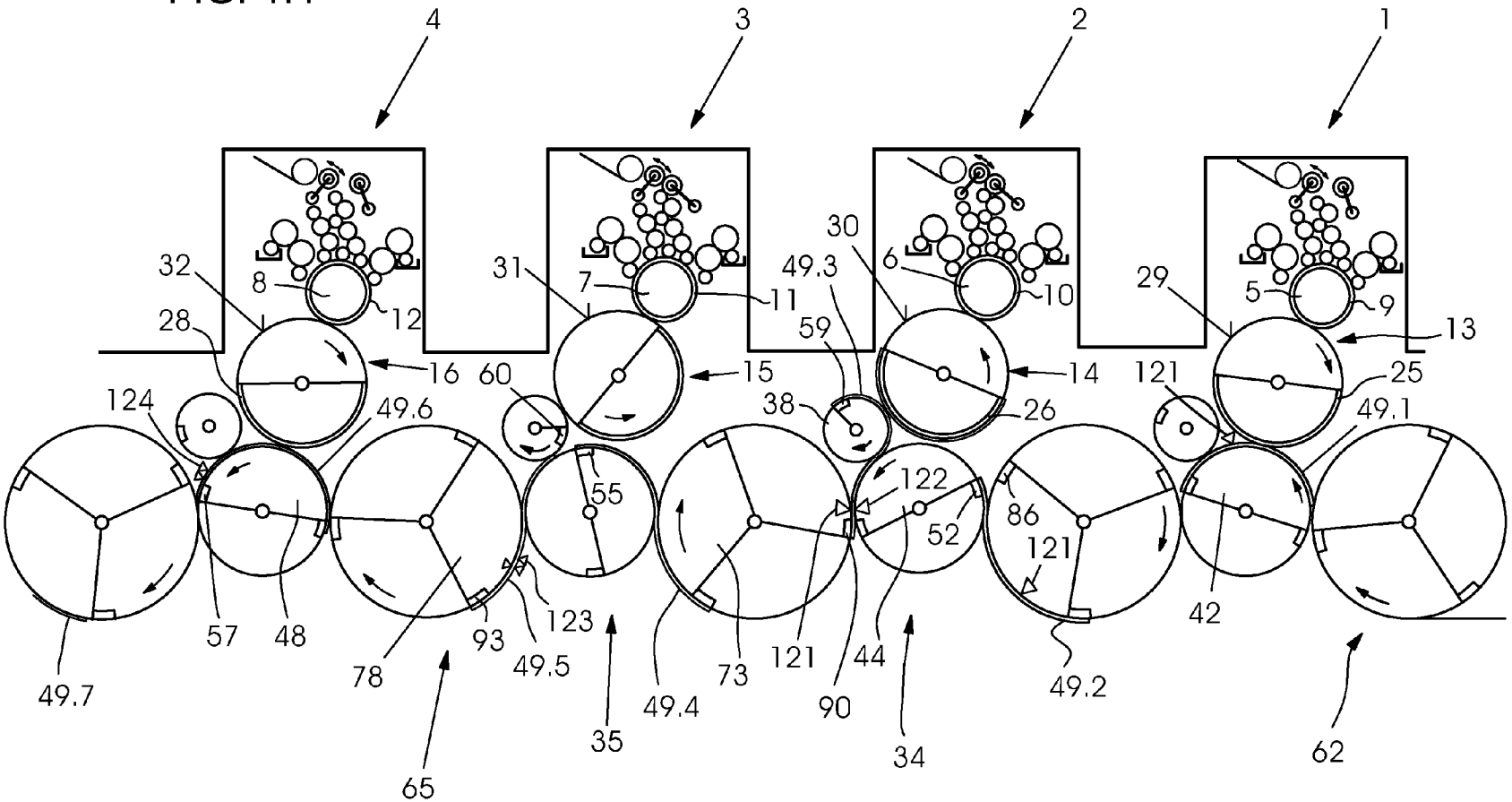
FIG. 1.4

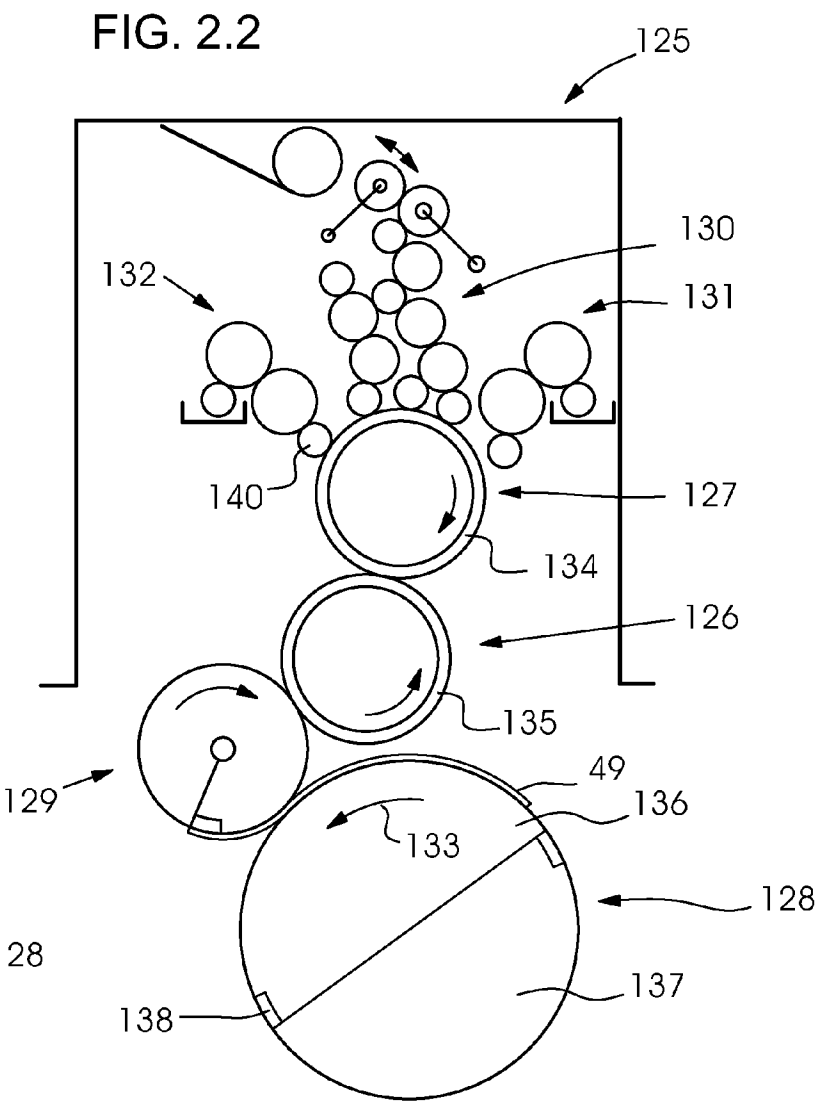
FIG. 2.2
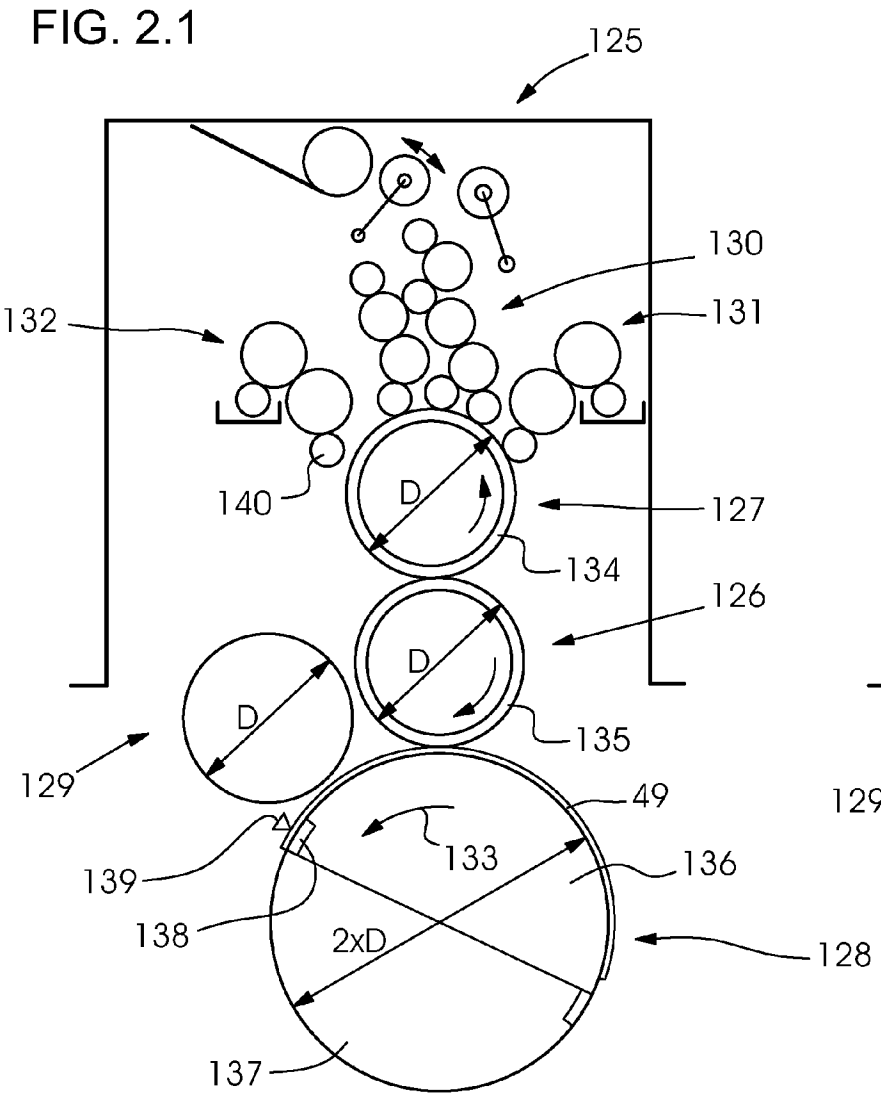
FIG. 2.1

SHEET-FED OFFSET PRINTING PRESS FOR PRINTING ON BOTH SIDES OF SHEETS

CROSS-REFERENCE TO RELATED APPLICATION

This application claims the priority, under 35 U.S.C. §119, of German Patent Application DE 10 2008 049 473.9, filed Sep. 29, 2008; the prior application is herewith incorporated by reference in its entirety.

BACKGROUND OF THE INVENTION

Field of the Invention

The invention relates to a sheet-fed offset printing press for printing on both sides of sheets, including a plurality of printing units disposed behind one another and each having at least one form cylinder, a transfer cylinder, a first impression cylinder and an inking unit with at least one ink applicator roll associated with the form cylinder.

It is known to place a plurality of homogeneous printing units behind one another in a sheet running direction in order to print sheets in multiple colors. The printing units have a high degree of repeated parts, so that manufacturing costs are low. A color separation is applied to one side of a sheet in each printing unit.

The sheets can be printed on the front side in a first pass and on the rear side in a second pass in order to print in multiple colors on both sides of the sheets. A machine of that type having satellite printing units is disclosed in German Published, Non-Prosecuted Patent Application DE 197 56 796 A1, corresponding to U.S. Pat. No. 6,293,193. Printing in two passes is time and cost-intensive.

In printing presses which print sheets in multiple colors on both sides in only one pass, a turning apparatus is provided between a final printing unit for printing on the front side and a first printing unit for printing on the rear side. The turning apparatus works and tumbles the sheets about a transverse axis or turns them over about a longitudinal axis. A turning apparatus increases the installation space of the printing press. Register errors are produced by multiple sheet transfers, as a result of which the prints on the front side and the rear side of the sheets have positional deviations with respect to one another.

A printing press according to German Patent DE 197 56 990 C2 includes an inline configuration of double printing units. Two blanket cylinders are operatively connected in each printing unit for simultaneous printing on both sides of the sheets. The axes of the sheet guiding cylinders are disposed in a horizontal plane. In each printing unit, printing form cylinders and inking units are disposed above and below that plane. The printing form cylinders and the inking units below the plane are accessible with difficulty for changeover and service purposes. The ink transport to the blanket cylinders is different above and below the plane due to gravity. When processing a print job, the inking units and the printing form cylinders below the plane are unused for printing only on the front side of the sheets. The double printing units have a high configuration.

German Patent DE 33 27 791 C1 describes a sheet-fed printing press having a plurality of printing units of inline construction, in which a plate cylinder, a blanket cylinder and an impression cylinder having identical diameters are provided in each printing unit. A sheet is fed in after every second revolution of a plate cylinder, in order to print on both sides of the sheets. The sheet is conveyed from the impression cylinder to the blanket cylinder in a printing unit and is given a verso print on the rear side in the nip between the plate cylinder and the blanket cylinder. Afterward, the sheet is again fed to the impression cylinder. During verso printing operation, the blanket cylinders and the plate cylinders can be raised up cyclically respectively from the impression cylinder and the blanket cylinder, with the result that a transfer of printing ink is interrupted when the relevant cylinder does not guide a sheet during every second revolution. The cyclical throwing on and off of cylinders impairs the print quality and leads to high wear of machine parts.

Printing units of inline construction according to German Patent DE 31 08 806 C2, corresponding to U.S. Pat. No. 4,409,894, each have a plate cylinder, a blanket cylinder and an impression cylinder for carrying out recto and verso printing. The impression cylinder carries a rubber blanket. The blanket cylinders are raised up from the respective impression cylinder during every second revolution. The disadvantages of throwing a cylinder on and off cyclically have already been mentioned above.

German Patent DE 437203 discloses a rotary printing press for printing both sides of a sheet in multiple colors. Printing is carried out on single size impression cylinders by way of double size plate and blanket cylinders. The blanket cylinders are integrated into the sheet guiding device. During verso printing operation, the impression cylinder is covered with a rubber blanket. During verso printing operation, the machine operates at half revolutions, with recto printing being carried out in the nip between two rubber blankets and verso printing being carried out conventionally in the nip between a blanket cylinder and an impression cylinder. The ink transfer in a rubber/rubber configuration is different from that in a rubber/impression cylinder configuration, which leads to varying color phenomena in the printed image that are not desired in any case.

SUMMARY OF THE INVENTION

It is accordingly an object of the invention to provide a sheet-fed offset printing press for printing on both sides of sheets in one pass, which overcomes the hereinafore-mentioned disadvantages of the heretofore-known devices of this general type, which has a compact construction and by way of which it is possible to print a number of color separations over one another in recto printing or recto and verso printing in a flexible manner and with high print quality.

With the foregoing and other objects in view there is provided, in accordance with the invention, a sheet-fed offset printing press for printing on both sides of sheets. The printing press comprises a plurality of printing units disposed behind one another. Each of the printing units includes at least one form cylinder, a transfer cylinder, a first impression cylinder and an inking unit having at least one ink applicator roll associated with the form cylinder. At least one of the printing units has a second impression cylinder interacting with the transfer cylinder and the first impression cylinder.

According to the invention, in an offset printing press having a plurality of printing units which are disposed behind one another, an additional impression cylinder which interacts with a transfer cylinder and a first impression cylinder is disposed in at least one printing unit. The operating mode of a printing unit which is equipped in such a way can be switched over, with the result that recto printing operation or recto and verso printing operation is possible selectively. Depending on the switching position of the transfer cylinder and the additional impression cylinder, a sheet is turned during printing and is printed on its rear side, or not turned and printed only on the front side. In an inline configuration having a plurality of printing units which are equipped in this way, all of the printing units can be switched to recto printing operation and recto and verso printing operation. The number of prints can therefore be configured as desired on the front side and the rear side. For example, it would be possible, in a printing press having eight printing units, to process print jobs, in which eight colors are printed on one side or seven are printed over one, six over two, five over three or four colors over four are printed on the front side and the rear side of the sheet. During the pass, a sheet can be turned twice or multiple times. During pure recto printing operation, the sheets are fed at full revolutions. In verso printing operation, the sheets are fed at half revolutions, that is to say during every second revolution of a single size form cylinder.

The printing units of the sheet-fed printing press can be set up in line as desired in a modular construction. The vertical direction of the ink flow is identical in all of the printing units, with the result that it is possible to provide identical inking units for recto printing operation and recto and verso printing operation. The printing units are readily accessible from above for service purposes.

Other features which are considered as characteristic for the invention are set forth in the appended claims.

Although the invention is illustrated and described herein as embodied in a sheet-fed offset printing press for printing on both sides of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIGS. 1.1-1.4 are sheet running diagrams in fragmentary, diagrammatic, longitudinal-sectional views of an offset printing press having double size transfer cylinders;

FIGS. 2.1-2.2 are enlarged, fragmentary, longitudinal-sectional views of one variant of an offset printing unit having a single size transfer cylinder in recto and verso printing operation.

DETAILED DESCRIPTION OF THE INVENTION

Figure 3:
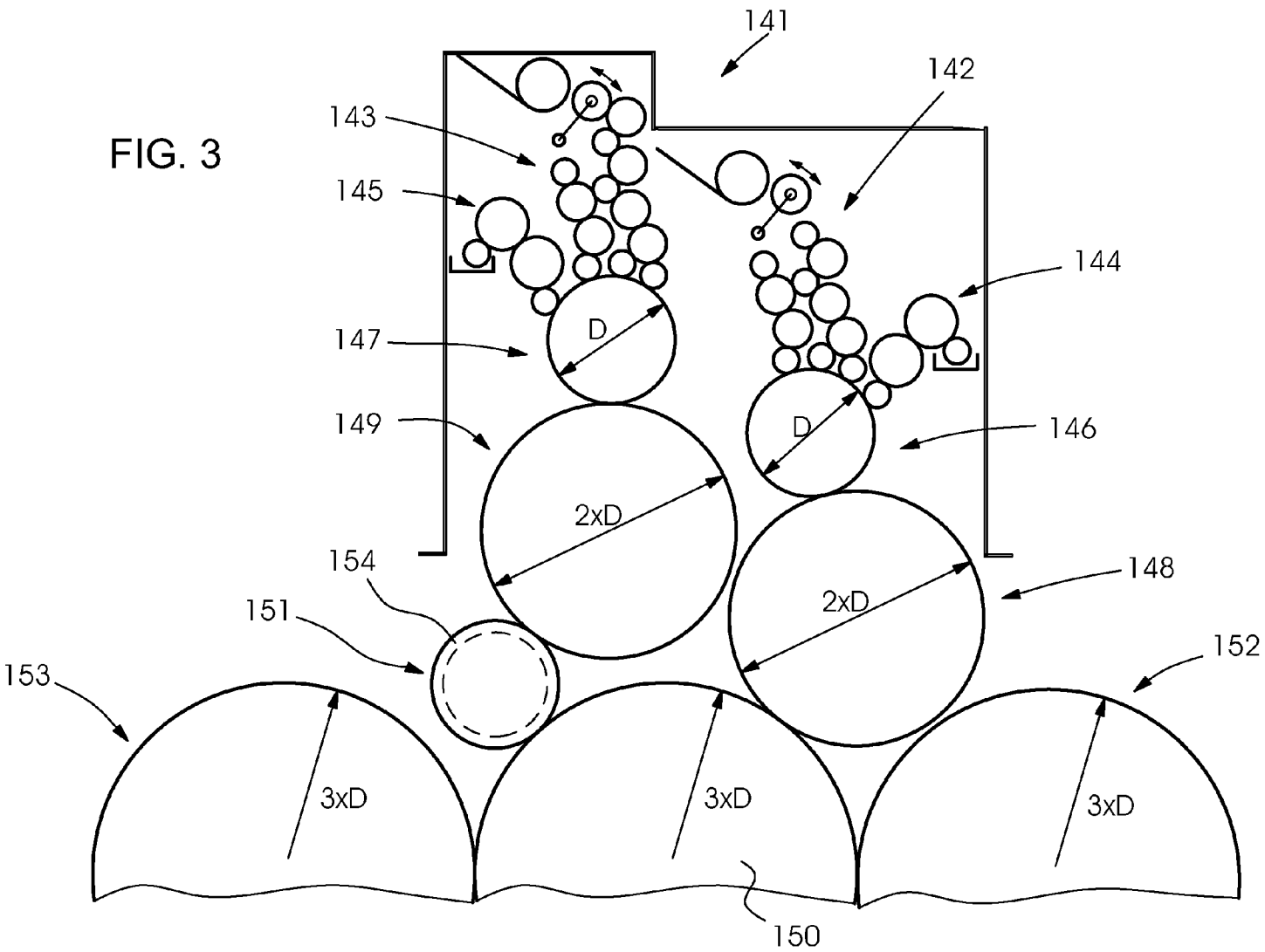
FIG. 3 is a further enlarged, fragmentary, longitudinal-sectional view of a variant of an offset printing unit having double size transfer cylinders and separate inking units.

Referring now to the figures of the drawings in detail and first, particularly, to FIGS. 1.1 to 1.4 thereof, there are seen four printing units 1 to 4 of a sheet-fed wet offset printing press, which are disposed horizontally behind one another. Each printing unit 1-4 includes a form cylinder 5-8 with a printing form 9-12. The printing forms 9-12 each lie on a respective active diameter D. Furthermore, each printing unit 1-4 includes a double size transfer cylinder 13-16. Two semicylindrical sectors 17-24 are each formed on a respective one of the transfer cylinders 13-16. Elastic covers 25-28 are mounted on the transfer cylinders 13-16 in the sectors 18, 19, 21 and 24. The covers 25-28 each lie on a respective active diameter 2×D. The transfer cylinders 13-16 do not have a surface 29-32 which transfers printing ink in the sectors 17, 20, 22, 23. Furthermore, each printing unit 1-4 includes a double size impression cylinder 33-36 and a single size impression cylinder 37 to 40. Two semicylindrical sectors 41-48 of the impression cylinders 33-36 each have circumferential faces which carry a sheet 49 and gripper systems 50-57 which hold the respective sheet 49 at the leading edge. The circumferential faces lie in each case on an active diameter 2×D. The impression cylinders 37-40 each have a circumferential face which carries a sheet 49 and gripper systems 58-61 which hold the sheet 49 at the leading edge. Triple size transfer drums 62-66 are provided for transporting the sheet 49 to the printing unit 1, between the printing units 1, 2; 2, 3; 3, 4 and away from the printing unit 4. Each of three sectors 67-81 of the transfer drums 62-66 have circumferential faces which carry the sheet 49 and gripper systems 82-96 which hold the respective sheet 49 at the leading edge. The circumferential faces of the transfer drums 62-66 each lie on a respective active diameter 3×D. An inking unit 97-100 and two dampening units 101-108 are provided in each printing unit 1-4. Ink applicator rolls of the inking units 97-100 and dampening solution applicator rolls of the dampening units 101-108 can be thrown on and off the printing forms 9-12. In the rotational direction of the printing forms 9-12, the ink applicator rolls lie between the dampening solution applicator rolls of the dampening units 101, 103, 105, 107 and 102, 104, 106, 108. The inking units 97-100 are configured as ductor inking units, with it being possible to connect an intermediate roll 117-120 in each case between a ductor roll 109-112 and an ink transfer roll 113 and 116. The transfer cylinders 13-16 can be thrown on and off the printing forms 9-12 and optionally the impression cylinders 33-36 and/or 37-40. All of the rolls, cylinders and drums of the printing units 1-4 can be driven in the direction of arrows 155 through the use of gear mechanisms and/or individual drives.

The printing units 1 and 4 are configured for printing on the front side of the sheets 49. In the printing units 1, 4, the intermediate rolls 117 and 120 and the dampening units 102 and 108 are out of operation, with the dampening solution applicator rolls of the dampening units 102, 108 being thrown off or disengaged from the printing forms 9, 12. Furthermore, the transfer cylinders 13, 16 are thrown on or engaged with the impression cylinders 33, 36 and are thrown off or disengaged from the impression cylinders 37, 40 in the printing units 1, 4. The impression cylinders 37, 40 are out of operation. The impression cylinders 13, 16 rotate in the clockwise direction.

The printing units 2 and 3 are configured for printing on the rear side of the sheets 49. In the printing units 2, 3, the intermediate rolls 118, 119 for ink transfer are connected between the ductor rolls 110, 111 and the ink transfer rolls 114, 115. The dampening units 104, 106 are in operation. The dampening units 103, 105 are out of operation. The transfer cylinders 14, 15 are in rolling contact with the printing forms 10, 11 and the impression cylinders 38, 39 and are thrown off or disengaged from the impression cylinders 34, 35. The transfer cylinders 14, 15 are driven counter to the clockwise direction. FIGS. 1.1-1.4 show a sheet transport in four phases. A sheet 49 is fed to a printing unit 1-4 during every second revolution of a form cylinder 5-8.

According to FIG. 1.1, a sheet 49.1 is conveyed in the gripper system 82 on the transfer drum 62. A sheet 49.2 is printed on the front side with a first color separation 121 in a nip between the cover 25 and the circumferential face in the sector 42 and is transferred through the use of the gripper system 86 out of the grippers of the gripper system 51 from the impression cylinder 33. A further sheet 49.3 is transferred out of the grippers of the gripper system 52 of the impression cylinder 34 to the grippers of the gripper system 59 of the impression cylinder 38. A sheet 49.4 receives a print of a first color separation 122 on the rear side in the nip between the cover 26 and the impression cylinder 38. In the printing unit 3, a sheet 49.5 is guided in the gripper system 60 on the impression cylinder 39. The end of the sheet 49.5 is guided on the circumferential face in the sector 46. A sheet 49.6 is conveyed through the use of the gripper system 91 on the circumferential face of the sector 76. The sheet 49.6 receives a print of a second color separation 123 on the rear side in the nip between the cover 27 and the impression cylinder 39. A sheet 49.7 receives a print of a second color separation 124 on the front side in the nip between the cover 28 and the circumferential face in the sector 48 of the impression cylinder 36. The sheet 49.7 is conveyed by way of the gripper system 95 of the transfer drum 66 to the next printing unit or to a stack.

FIG. 1.2 shows the situation after one full revolution of the form cylinders 5-8. The sheet 49.1 is transferred out of the grippers of the gripper system 82 of the transfer drum 62 to the grippers of the gripper system 51 of the impression cylinder 33. The printing ink for a further front side color separation 121 is transferred by the printing form 9 on the cover 25. The sheet 49.2 is conveyed further through the use of the gripper system 86 on the transfer drum 63. In the printing unit 2, the cover 26 receives the printing ink of a first color separation 122 for the rear side of the sheet 49.3 which is conveyed by way of the gripper system 59 on the impression cylinder 38. The sheet 49.4 is conveyed by way of the gripper system 88 from the impression cylinder 34 to the impression cylinder 35. The sheet 49.5 is conveyed through the use of the gripper system 60 through the press nip between the cover 27 and the impression cylinder 39. The printing ink of the second color separation 123 is transferred from the cover 27 onto the rear side of the sheet 49.5. The sheet 49.6 is conveyed further on the circumferential face of the sector 76 through the use of the gripper system 91. In the printing unit 4, the printing ink of the second color separation 124 for the front side is transferred from the printing form 12 onto the cover 28. The sheet 49.7 is conveyed in the gripper system 95 on the transfer drum 66.

FIG. 1.3 shows a situation after a further revolution of the form cylinders 5-8. The sheet 49.1 is conveyed on the impression cylinder 33 in the gripper system 51 into the press nip between the cover 25 and the circumferential face of the sector 42, in order to receive the first color separation 121 on the front side. The sheet 49.2 is conveyed through the use of the gripper system 86 on the transfer drum 63. In the printing unit 2, the sheet 49.3 receives the first color separation 122 on the rear side in the press nip between the cover 26 and the impression cylinder 38. The sheet 49.4 is transferred out of the grippers of the gripper system 88 to the grippers of the gripper system 55 of the impression cylinder 35. Furthermore, the sheet 49.5 has been transferred from the gripper system 60 to the gripper system 54 of the impression cylinder 35. In the nip between the impression cylinder 35 and the transfer drum 65, the sheet 49.5 is transferred to the gripper system 93 in the sector 78 of the transfer drum 65. The sheet 49.6 is conveyed by way of the gripper system 57 into the press nip between the cover 28 and the circumferential face in the sector 48 of the impression cylinder 36. The sheet 49.7 is conveyed further through the use of the gripper system 95 in the sector 80 of the transfer drum 66.

According to FIG. 1.4, the transfer cylinders 13-16 are situated in rotational positions, in which the surfaces 29-32 are opposite the printing forms 9-12, with the result that no printing ink is transferred from the printing forms 9-12 to the transfer cylinders 13-16. The sheet 49.1 receives the first color separation 121 on the front side in the press nip between the cover 25 and the circumferential face in the sector 42. The sheet 49.2 has been transferred out of the grippers of the gripper system 86 to the grippers of the gripper system 52. While the end of the sheet 49.3 receives the first color separation 122 on the rear side in the nip between the cover 26 and the impression cylinder 38, the sheet 49.3 is peeled from the circumferential face in the sector 44 of the impression cylinder 34 through the use of the gripper system 90. The sheet 49.4 is conveyed through the use of the gripper system 55 on the impression cylinder 35 and is removed from the circumferential face in the sector 73. The sheet 49.5 has received the second color separation 123 on the rear side and is conveyed by way of the gripper system 93 in the sector 78 of the transfer drum 65. The leading sheet 49.6 receives the second color separation 124 on the front side in the press nip between the cover 28 and the circumferential face in the sector 48.

The configuration of the printing units 1-4 as recto printing units and as verso printing units is embodied in this case only by way of example. In principle, each printing unit can be configured for printing on the front side or rear side. During printing on the rear side, a single size impression cylinder 37-40 is included into the sheet run in any case. The printing press can be configured as a pure recto printing press if in each case both sectors 17-24 of the transfer cylinders 13-16 are equipped with covers which transfer printing ink. In pure recto printing operation, one sheet 49 can be fed to a printing unit 1-4 with every revolution of a form cylinder 5-8.

In one variant according to FIGS. 2.1 and 2.2, printing units 125 are equipped with transfer cylinders 126 which have the same active diameter D as respectively associated form cylinders 127. As in the variant according to FIGS. 1.1-1.4, in each case the transfer cylinder 126 interacts selectively with an impression cylinder 128 and 129 which have respective active diameters of 2×D and D. The configuration of inking units 130 and dampening units 131, 132 is as described with respect to FIGS. 1.1-1.4.

According to FIG. 2.1, a printing unit 125 is configured in recto printing operation. The transfer cylinder 126 is thrown off the impression cylinder 129 and is thrown on the impression cylinder 128. The impression cylinder 129 is functionless during recto printing operation. Furthermore, the inking unit 130 and the dampening unit 131 are set in operation. The dampening unit 132 is out of operation. The cylinders and rolls can be driven in the direction of the arrows 133.

During each revolution of the form cylinder 127, a printing form 134 is inked with an image by way of the dampening unit 131 and the inking unit 130. The printing ink of the color separation is transferred onto an elastic cover 135 of the transfer cylinder 126. The double size impression cylinder 128 has two sectors 136, 137. If a sheet 49 is held in a gripper system 138 and is conveyed on the circumferential face of the impression cylinder 128 in the sector 136, a color separation 139 is transferred to the front side of the sheet 49 in the nip between the cover 135 and the impression cylinder 128. No sheet 49 is guided in the sector 137. During passing of the sector 137 on the transfer cylinder 126, the transfer cylinder 126 is thrown off the impression cylinder 128. As an alternative, the circumferential face can stand back in the sector 137, with the result that no printing ink is transmitted on the circumferential face.

In one alternative embodiment, the circumferential face can be configured to carry printing ink in the sector 137 in pure recto printing operation. A sheet is then fed at single revolutions with each revolution of the form cylinder 127.

In verso printing operation according to FIG. 2.2, the rotational directions of the transfer cylinder 126 and the form cylinder 127 are changed with respect to recto printing operation. The transfer cylinder 126 is thrown off the impression cylinder 128 and is thrown on the impression cylinder 129. The impression cylinder 129 is thrown on the impression cylinder 128, in order to accept a sheet 49. The dampening unit 131 is taken out of operation. The dampening solution applicator roll 140 of the dampening unit 132 is thrown onto the printing form 134. In verso printing operation, a sheet 49 is transferred from the impression cylinder 128 to the impression cylinder 129. The sheet 49 receives a first print on the rear side in the nip between the cover 135 and the impression cylinder 129. During every second revolution of the impression cylinder 127, the transfer cylinder 126 is raised up from the impression cylinder 129, with the result that the circumferential face of the impression cylinder 129 is not inked in an undesired manner.

FIG. 3 shows a variant with a printing unit 141 which includes two inking units 142, 143, two dampening units 144, 145, two form cylinders 146, 147 and two half revolution transfer cylinders 148, 149. The transfer cylinder 148 interacts with an impression cylinder 150. The transfer cylinder 149 interacts with an impression cylinder 151. Furthermore, the impression cylinders 151 and 150 interact. The impression cylinder 150 is assigned transfer drums 152, 153. The form cylinders 146, 147 and the impression cylinder 151 have an active diameter D. The transfer cylinders 148, 149 are twice as large with a diameter 2×D. The transfer drums 152, 153 and the impression cylinder 150 are triple size with an active diameter 3×D.

A first color separation is transferred on the front side of a sheet in recto printing in the nip between the transfer cylinder 148 and the impression cylinder 150. The sheet is transferred from the impression cylinder 150 to the impression cylinder 151. The sheet receives a print of a color separation on the rear side in the nip between the transfer cylinder 149 and the impression cylinder 151. Subsequently, the sheet is transferred to the impression cylinder 150 again. The sheet which is printed on both sides passes from the impression cylinder 150 to the transfer drum 153. The transfer drum 153 conveys the sheet to a following printing unit or to an apparatus for conveying it onto a stack.

The printing unit 141 can be configured in such a way that a sheet receives two prints on the front side. To this end, an elastic cover 154 is pulled onto the circumferential face of the impression cylinder 151. In this configuration, a sheet is not transferred from the impression cylinder 150 to the impression cylinder 151. The second print takes place in the nip between the impression cylinder 151 and the cover 154. Before this, the second color separation is transferred from the form cylinder 147 onto the transfer cylinder 149 and onto the cover 154.

The invention claimed is:

1. A sheet-fed offset printing press for printing on both sides of sheets, the printing press comprising:

a plurality of printing units disposed behind one another;

each of said printing units including at least one form cylinder, a single transfer cylinder, a first impression cylinder and an inking unit having at least one ink applicator roll associated with said form cylinder;

at least one of said printing units having a second impression cylinder interacting with said single transfer cylinder and said first impression cylinder;

said single transfer cylinder configured to be thrown off said first impression cylinder while said second impression cylinder is thrown on said single transfer cylinder and said first impression cylinder;

said first and second impression cylinders both configured to be engaged and disengaged only by said single transfer cylinder;

said form cylinder and said single transfer cylinder configured for changing rotational directions; and said form cylinder and said single transfer cylinder configured for displacing phase positions relative to said impression cylinders.

2. The sheet-fed offset printing press according to claim 1, which further comprises at least one individual drive to be respectively coupled to at least one of said form cylinder or said single transfer cylinder or said second impression cylinder.

3. The sheet-fed offset printing press according to claim 1, which further comprises a gripper controller associated with said second impression cylinder, said gripper controller configured to be activated upon being thrown on said first impression cylinder.

4. The sheet-fed offset printing press according to claim 1, wherein at least one of said printing units includes two dampening units each having at least one dampening solution applicator roll associated with said form cylinder, each dampening solution applicator roll configured to be thrown on a printing form disposed on said form cylinder, in front of said ink applicator roll in rotational direction of said form cylinder.

5. The sheet-fed offset printing press according to claim 4, which further comprises an intermediate roll, and a first ink transfer roll, said inking unit being equipped with an ink fountain roll and a ductor roll, and said intermediate roll configured to be connected between said ductor roll and said first ink transfer roll.

6. The sheet-fed offset printing press according to claim 4, wherein one-half of said single transfer cylinder, in circumferential direction, has a surface for transferring printing ink.

7. The sheet-fed offset printing press according to claim 1, wherein said second impression cylinder and said form cylinder have diameters, and said single transfer cylinder and said first impression cylinder have diameters being double said diameters of said second impression cylinder and said form cylinder.

8. The sheet-fed offset printing press according to claim 7, which further comprises a transfer drum disposed in front of said first impression cylinder, said transfer drum having a diameter being triple said diameters of said second impression cylinder and said form cylinder.

9. The sheet-fed offset printing press according to claim 1, wherein said form cylinder, said single transfer cylinder and said second impression cylinder have diameters being half as large as a diameter of said first impression cylinder.

10. The sheet-fed offset printing press according to claim 9, wherein one-half of said first impression cylinder has a surface shell springing forward and recoiling.

11. The sheet-fed offset printing press according to claim 10, wherein said form cylinders and said second impression cylinder have diameters, said single transfer cylinders have diameters being twice as large as said diameters of said form cylinders and said second impression cylinder, and said first impression cylinder has a diameter being three times as large as said diameters of said form cylinders and said second impression cylinder.

12. The sheet-fed offset printing press according to claim 10, wherein said second impression cylinder has a surface transferring printing ink.

13. The sheet-fed offset printing press according to claim 10, wherein said form cylinders and said single transfer cylinders rotate in different directions.

14. The sheet-fed offset printing press according to claim 1, wherein:

at least one of said printing units includes a first inking unit, a first form cylinder and a first transfer cylinder interacting with said first impression cylinder, for printing on a front side of a sheet; and at least one of said printing units includes a second inking unit, a second form cylinder and a second transfer cylinder interacting with said second impression cylinder for printing on a rear side of the sheet.

15. The sheet-fed offset printing press according to claim 1, wherein said printing units are configured for receiving precisely one sheet after every second revolution of said form cylinders, during printing on a rear side of the sheets.

* * * * *